United States Patent [19]

Cable

[11] 4,130,970

[45] Dec. 26, 1978

[54] LOW COST HOUSING WALL STRUCTURE

[75] Inventor: Daniel K. Cable, Lakewood, Calif.

[73] Assignee: Angeles Metal Trim Co., Los Angeles, Calif.

[21] Appl. No.: 364,293

[22] Filed: May 29, 1973

Related U.S. Application Data

[63] Continuation of Ser. No. 145,209, May 20, 1971, abandoned.

[51] Int. Cl.[2] ..... E04H 1/04

[52] U.S. Cl. ..... 52/236.3; 52/648

[58] Field of Search ..... 52/236, 349, 206, 236.3, 52/648

[56] References Cited

U.S. PATENT DOCUMENTS

| | | | |
|---|---|---|---|
| 1,821,015 | 9/1931 | Hull | 52/349 |
| 2,023,814 | 12/1935 | Lindsey | 52/90 |
| 2,313,839 | 3/1943 | Olsen | 52/206 |

OTHER PUBLICATIONS

Sweet's Architectural Catalog File by McGraw Hill, 1965, 2a/In, p. 2.

Design of Steel Structures by Bresler by Wiley & Sons, pp. 573–580.

Sweet's Architectural Catalog File by McGraw Hill, 1962, 12a/Al, pp. 8 and 9; 12c/uni pp. 30 & 31.

*Primary Examiner*—John E. Murtagh

*Attorney, Agent, or Firm*—Reed C. Lawlor

[57] ABSTRACT

The present invention comprises a portable wall structure for use on the top floor of a multiple story building. The wall structure includes a metal cap forming the top of a wall structure, a metal floor track forming the bottom of the wall structure, and a series of channeled load-bearing studs that are secured vertically between the cap member and the floor track member. These vertical studs are composed of steel of about 26 gauge thickness. This wall structure forms a separate unit which may be prefabricated and separately transported to a building construction site for use on the top floor of a multiple story building. Some parts, such as top plates, corners, door surrounds, and window surrounds, made of wood, are included in some embodiments of the invention.

4 Claims, 12 Drawing Figures

INVENTOR
DANIEL K. CABLE
BY
ATTORNEY

INVENTOR
DANIEL K. CABLE

BY Reed B. Lawlor
ATTORNEY

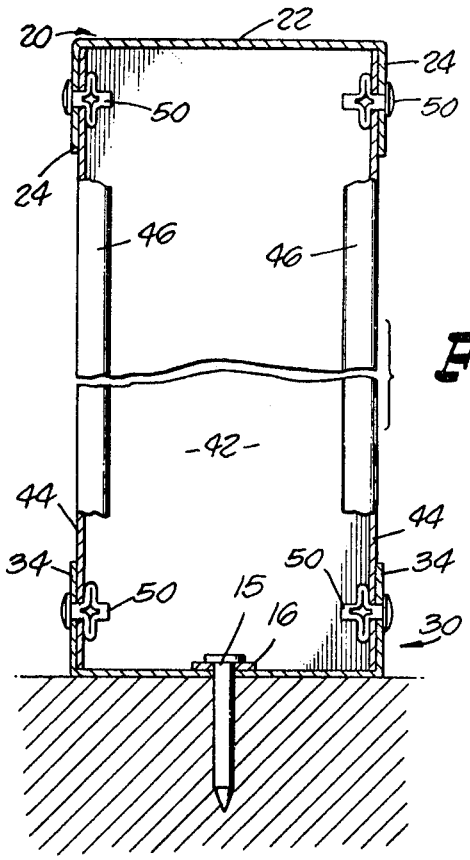
FIG. 3.
FIG. 4.
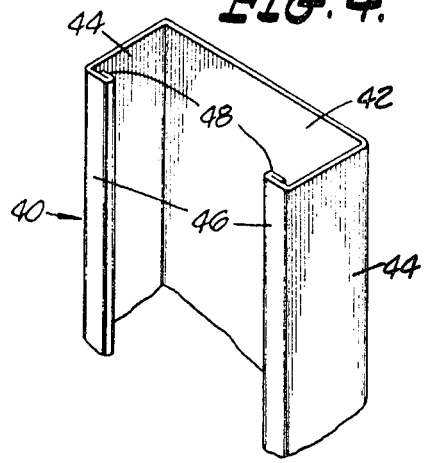
FIG. 5.
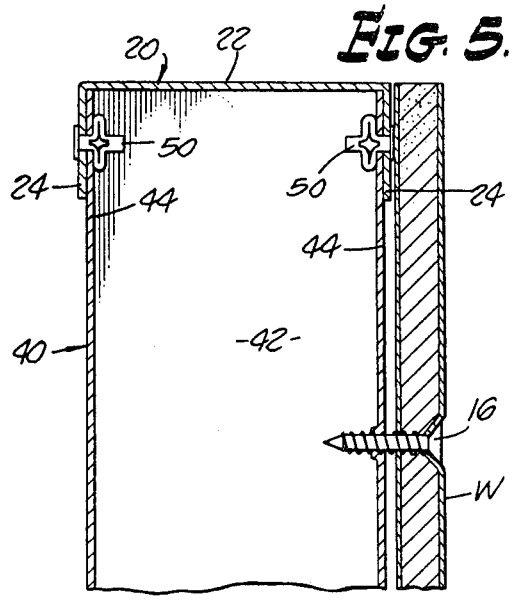
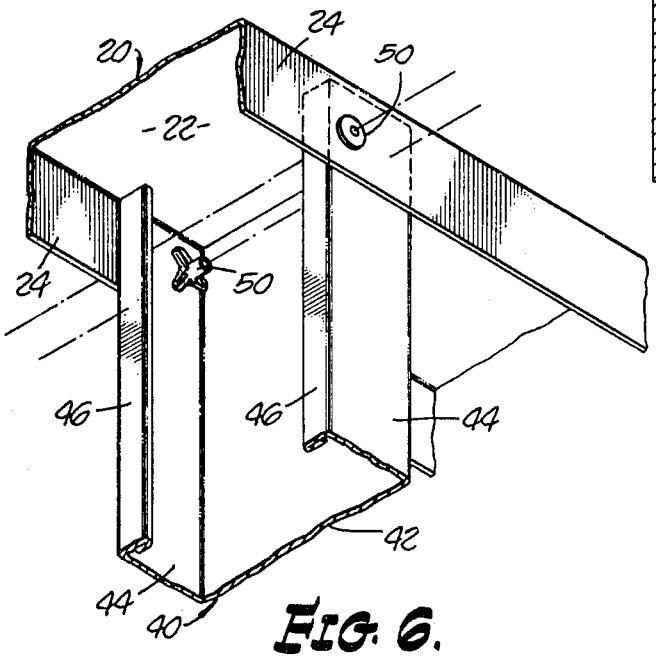
FIG. 6.
INVENTOR
DANIEL K. CABLE
BY
ATTORNEY

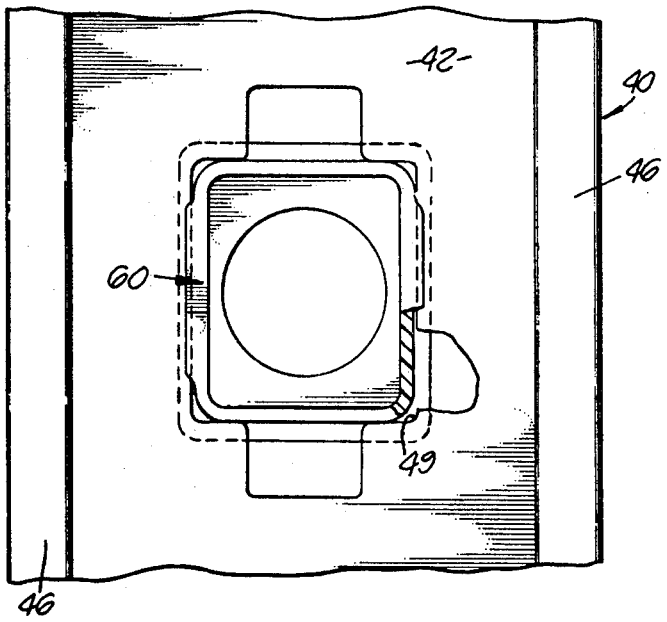
FIG. 7.
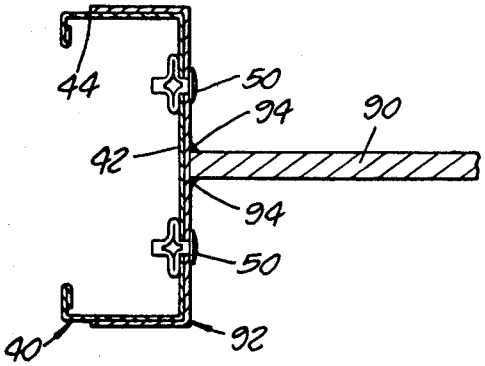
FIG. 11.
FIG. 12.
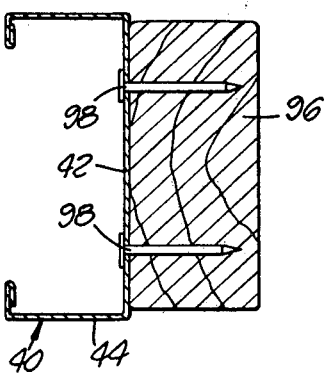
INVENTOR
DANIEL K. CABLE
BY
ATTORNEY

INVENTOR
DANIEL K. CABLE

BY

ATTORNEY

LOW COST HOUSING WALL STRUCTURE

CROSS REFERENCES TO RELATED APPLICATIONS

This is a continuation of application Ser. No. 145,209, filed May 20, 1971, now abandoned. Patent application Ser. No. 35,648, filed May 8, 1970, now abandoned. Patent application Ser. No. 39,603, filed May 22, 1970, now abandoned.

BACKGROUND OF THE INVENTION

This invention relates to a wall structure capable of use for the top story of a multiple story building and, more specifically, to a prefabricated wall section in which the load-bearing studs are composed of steel of about 26 gauge thickness. These studs are secured vertically between a metal cap member and a floor track member which form the top and bottom of the wall section respectively.

Load-bearing wall sections commonly used in construction for the top floors of buildings are made either entirely of wood or of metal load-bearing studs having a thickness of 16 gauge or thicker. These metal wall sections suffer from the disadvantages of being heavy, unwieldy, and relatively unworkable with the hand tools usually found at a construction site. In addition, wood wall sections, though workable, are usually not uniform in size since variations in humidity affect the dimensions of wooden members. For this reason, a wooden wall section of uniform and stable characteristics is difficult to produce economically.

It has commonly been assumed by those in the construction industry that in order to meet the requirements of a load-bearing wall on the top story of a building, load-bearing studs composed of wood or of 16 gauge or thicker steel had to be employed. In some areas, the requirements for such a load-bearing wall are that, where the studs are 16 inches apart, the wall section be able to support a load on its top plate of at least 500 pounds per lineal foot and be able to withstand a wind load of at least 15 pounds per square foot, or that the wall section be able to support about 305 pounds per lineal foot and be able to withstand a wind load of at least 20 pounds per square foot. The disadvantages of wooden wall sections and heavy steel wall sections were previously accepted as unavoidable in order to obtain the required load-bearing characteristics for the wall section.

It has recently been discovered that the load-bearing studs of a multiple story dwelling, such as a two- or three-story house, can be made of 20 gauge steel.

I have now discovered that by making the top story walls of prefabricated metal load-bearing wall sections which are composed of steel load-bearing studs having a thickness of about 26 gauge, the entire wall sections, and also the entire building structure, acquires new and desirable characteristics and has many advantages over the wall sections previously employed while still exhibiting the necessary load-bearing characteristics. As used herein, "26 gauge" means the thickness of a member within the range of 25 to 27 gauge, 0.627 to 0.513 mm, or 0.0247 to 0.0202 inches. The steel referred to herein is hot dipped galvanized strip steel. An example of the type of steel employed is designated as ASTM-A446A. This steel has a yield strength of 33,000 psi and a tensile strength of 45,000 psi, thus rendering it suitable for use in both single-story and on the top floor in two-story construction.

Besides the usual advantages of repeatability of quality and accuracy and speed of construction attributable to most prefabricated structures, the main advantage of my invention is the achievement of a lightweight wall section which possesses the necessary load-bearing and other characteristics required for use in a load-bearing wall on the top story of a building under certain conditions. Such 26 gauge wall sections may be employed, for example, where the load on the top plate of the wall section is 500 pounds per lineal foot or less and where the wind load requirements are 15 pounds per square foot or less. At the same time, a lightweight wall section is provided and further advantages are evident when such a 26 gauge wall section is combined with load-bearing wall sections composed of 20 gauge studs on the lower stories of a multiple story building. That such 26 gauge wall sections meet such industry standards and requirements comes as a complete surprise to those in the building construction field. This invention is particularly useful in providing low cost housing and will result in substantial cost savings.

Typically a 10 foot wall section constructed of 20 gauge steel studs would weigh about 70 pounds, a similar wall section constructed of 2×4 wooden members would weigh about 134 pounds. But in this invention, a similar wall section constructed of 26 gauge steel studs typically weighs only about 40 pounds. This allows the 26 gauge sections to be easily carried and erected by hand, if desired, without the use of cranes and other heavy equipment while at the same time obtaining the necessary load-bearing characteristics for a top story wall.

It will be evident that such a 26 gauge wall section may be used as a load-bearing wall either in a single story building or on the top floor of a multiple story building. In multiple story buildings, the use of such 26 gauge wall sections on the top floor is especially advantageous when combined with load-bearing wall sections having 20 gauge load-bearing studs used in the lower floors. This combination results in an even greater reduction in the time required to construct such a multiple story building than if 26 gauge wall sections were used for the top story and wooden wall sections for the bottom stories.

The wall section of this invention has the additional advantage of being workable. That is, the members of a wall section constructed of 26 gauge steel may be cut at the construction site with a hand-held power saw or with metal shears, or the like. Pieces of the 26 gauge steel members may be bent and formed by hand in order to provide apertures or spaces in the members for the passage of previously installed plumbing and the like. Screws may also be conveniently driven through 26 gauge steel in order to secure wallboard and the like to the metal members. Nails may be driven through 26 gauge steel with a hammer into wooden members on the opposite side in order to secure the wooden members to the metal members.

The wall section of this invention is also flexible to such an extent that it will conform to irregularities in a concrete floor of the type which is often employed in the construction of residential homes. The type of irregularity referred to is not surface roughness but rather irregularities such as a 10 foot section of floor which is bowed so that its center is ½ inch higher than its ends.

In the best embodiment, the metal studs of the wall section of this invention are C-shaped. This C-shape of the metal studs gives the studs more load-bearing capability and also gives the flanges of the studs more rigidity so that the flanges are less likely to bend when screws and the like are driven through the flanges in order to secure a wallboard and the like to the flanges.

All of these advantages of lightweight, workability, flexibility, and maneuverability provide a substantial saving in cost to the constructor, thus enabling him to provide low cost housing. For example, a typical two-story residential house may be framed with the 20 gauge steel prefabricated wall sections on the lower story and 26 gauge wall sections on the upper story. The upper story would be framed in approximately one hour. This is about four to eight times faster than the same story could be framed if wooden wall sections constructed at the building site were employed. If prefabricated wooden wall sections are employed, extra cost to the contractor results from the extra weight of the wooden wall sections.

SUMMARY OF THE INVENTION

This invention provides a load-bearing metal wall structure for use in the top story of a multiple story building structure which comprises an elongated normally horizontal cap member adapted to overlie the top of a series of metal studs and an upwardly facing metal floor track member adapted to receive the lower ends of a series of metal studs. The cap member forms the top of the wall structure, and the track member forms the bottom of the wall structure. A series of load-bearing studs are secured vertically between the cap member and the floor track member. These studs are composed of steel of about 26 gauge thickness.

Many objects and advantages of this invention will become evident to those skilled in the art upon a reading of the following detailed description and drawings wherein:

FIG. 3 is a sectional elevation view of a portion of a wall section of this invention;

FIG. 4 is a perspective view of a typical stud employed in this invention;

FIG. 5 is a sectional elevation view taken along the line 5—5 of FIG. 1;

FIG. 6 is a perspective view showing the connection of one of the studs and the cap member employed in this invention;

FIG. 7 is a sectional elevation view of the back side of an insulating guide employed in this invention;

FIG. 11 is a sectional plan view taken along the line 11—11 in FIG. 9; and

FIG. 12 is a sectional plan view taken along the line 12—12 in FIG. 9.

Figure 1:
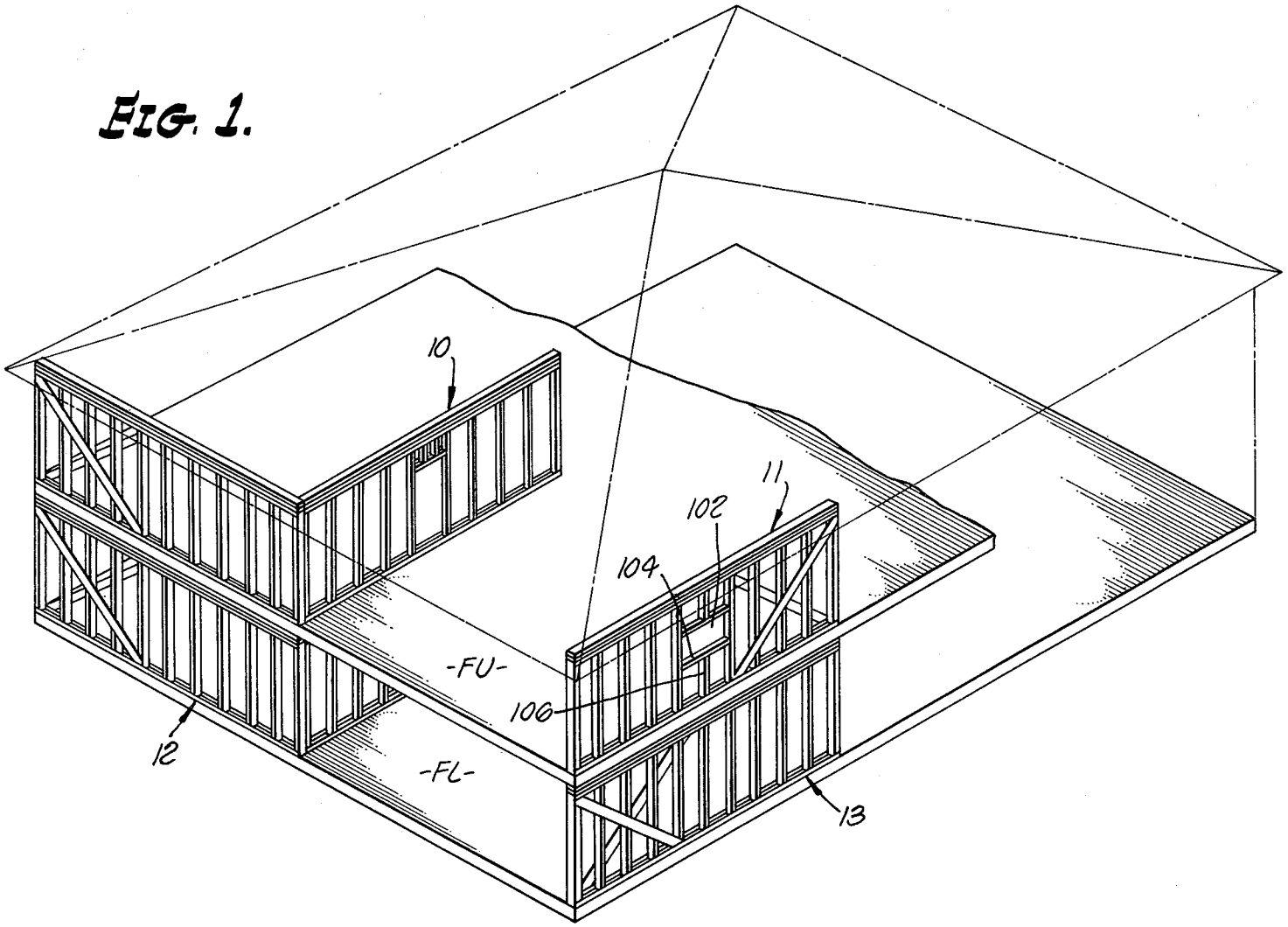
FIG. 1 is a perspective view of a part of a multiple story residential home during construction showing partial framing of the house utilizing the wall structures of this invention.

FIG. 1 is a perspective view of a typical two-story residential house which has been partially framed with 26 gauge wall structures or wall sections 10 and 11 and with 20 gauge wall sections 12 and 13. Although the 26 gauge wall section of this invention may be employed in single story structures, it is especially useful when employed in the top floor of multiple story buildings where the load-bearing walls of the lower stories are constructed of 20 gauge studs. The invention will therefore be discussed hereinafter primarily with regard to FIG. 1 which shows a multiple story building in which the studs of the upper story load-bearing walls are composed of 26 gauge steel and the studs of the lower story load-bearing walls are composed of 20 gauge steel. It will therefore be understood that the "upper story" or "top story" refers both to the uppermost story of a multiple story building and to the single story of a one-story building.

Wall sections 10, 11, 12, and 13 are prefabricated at a plant remote from the building construction site and are transported to the building construction site by truck. 20 gauge wall sections 12 and 13 are then first carried from the truck, placed on the house floor FL, and held in place while they are secured to the floor FL and to each other. 26 gauge wall sections 10 and 11 are similarly brought from the truck and secured to upper floor FU and to each other.

Wall sections 10, 11, 12, and 13 are typically 16 or 20 feet in length, 8 to 10 feet high, and 2½ to 6 inches wide. In the best embodiment of this invention, the wall sections are 16 feet long, 8 feet high, and 3⅝ inches wide. This wall section can be easily handled by two men. If the wall sections are constructed in greater lengths, say 30 feet, they will become practically uncontrollable because of the flexibility of the wall section.

If the floor of the house consists of a concrete slab, it is the common practice to secure the wall sections to the floor by shooting pins 15 through washers 16, through the web 32 of the track 30 (see FIG. 3) of the wall section 10, and into the concrete floor. If the floor is wooden, the wall sections may be secured to the floor by nailing through the track member 30. The wall sections 10, 11, 12, and 13 are then secured to adjacent wall sections as will be explained hereinafter.

Figure 2:
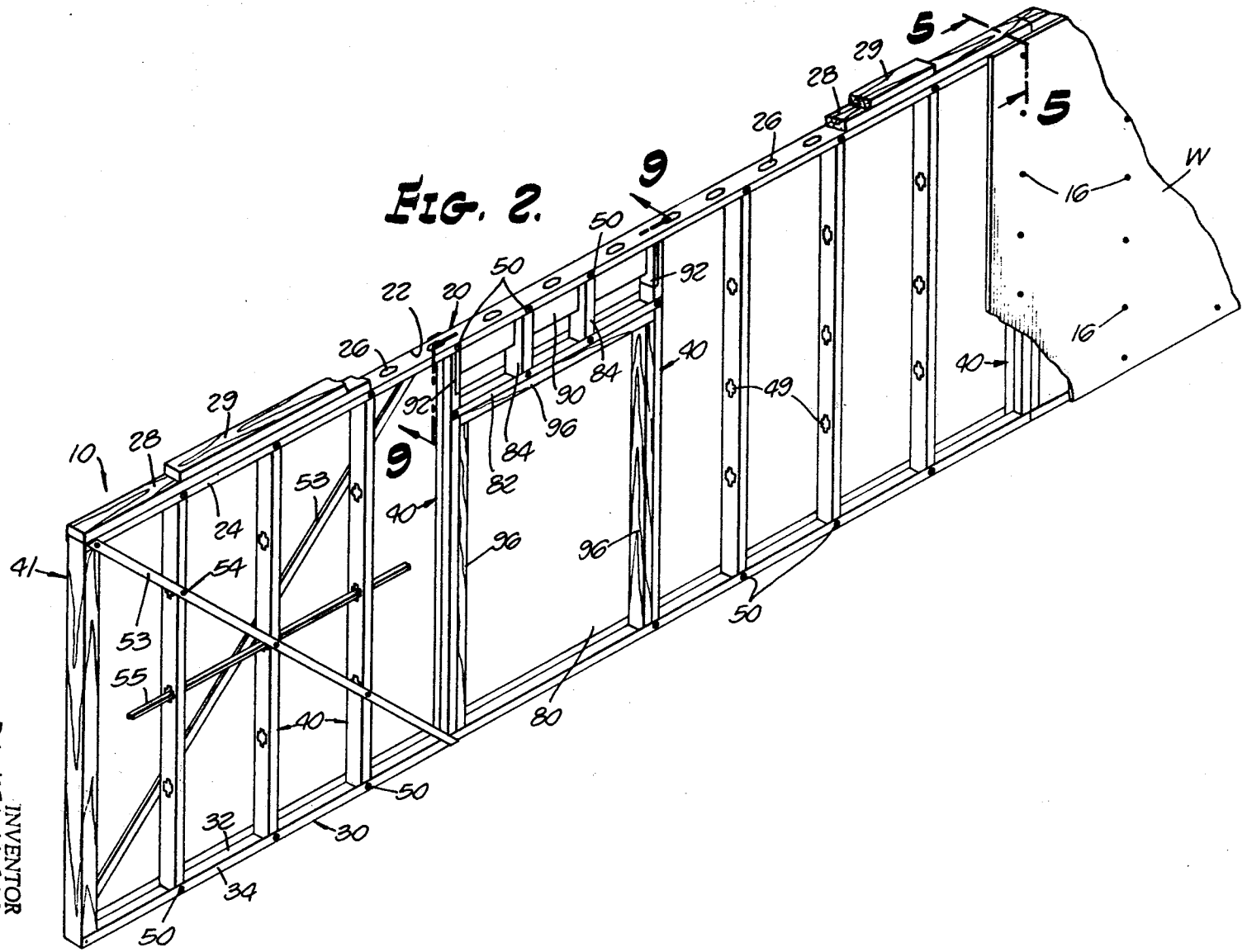
FIG. 2 is a perspective view of the wall section of this invention.

FIG. 2 shows 26 gauge upper wall section 10 in greater detail. Wall sections 12 and 13 are similar except for the gauge of the metal studs employed. Wall section 10 is composed of a downwardly facing channeled cap member 20, which provides the top of the wall section 10, and upwardly facing elongated channeled floor track member 30, which provides the bottom of the wall section 10. Cap 20 and floor track 30 are positioned horizontally above and below metal studs 40 respectively and, in the best embodiment of the invention, are both 16 feet in length.

As is shown in FIGS. 2 and 3, the top cap member 20 and the lower track member 30 are typically composed of U-shaped channeled metal members. Cap member 20 is composed of an elongated main web 32 and downwardly depending flanges 24 extending longitudinally of and integral with each side of main web 22. Floor track 30 is composed of elongated main web 32 and upstanding flanges 34 extending longitudinally of and integral with each side of main web 32. In the best embodiment of this invention, members 20 and 30 are composed of steel of about 26 gauge thickness.

As is shown in FIG. 2, a series of parallel channeled studs 40 are secured vertically between the cap member 20 and the floor track member 30 every 16 or 24 inches. In the best embodiment of this invention, studs 40 are composed of C-shaped channeled members, having a thickness of about 26 gauge. This C-shape is best seen in FIG. 4. Channeled studs 40 are composed of a main web 42 and relatively narrow flanges 44 extending longitudinally of and integral with each side of web 42.

In the best embodiment of the invention, stud 40 is also provided with inwardly projecting flange lips 46 and returns 48 extending along the length of and integral with flanges 44. It is common practice to screw wallboard W and the like to flanges 44 of studs 40 with screws 16 passing through the flanges 44 (see FIGS. 2 and 5). Lips 46 and returns 48 provide structural strength to studs 40 and also provide rigidity to flanges 44 so that they will not bend inwardly towards each other when subjected to the force of the screws 16 when wallboard W is screwed to the studs 40.

The flanges 44 of the studs 40 may be secured to the flanges 24 and 34 of the cap member 20 and floor track member 30 respectively by rivets, welds, nails, clinching, screws, or the like. In the best embodiment of the invention, the studs 40 are secured to the cap 20 and floor track 30 by riveting, as is shown in FIGS. 3 and 5 or by spot welding (not shown). Riveting is employed because it provides a more flexible wall section than is obtained with the use of welding. However, welding is less expensive than the other methods mentioned.

"Low profile" blind rivets 50 are employed in this embodiment of the invention in order to prevent excessive bulging of the wallboards W which are to be secured to the stud flanges 44 (see FIG. 5). A low profile rivet 50 is one whose head is substantially flat, about 1/16 inch thick, and which may be driven so that its head will rest flat against the flange 24 of the cap member 20 to present a relatively smooth surface to the interior of any wallboard W which may later be secured to the stud 40. These rivets 50 secure each flange 24 of the cap member 22 and each flange 34 of the floor track 30 to each flange 44 of the stud 42.

As is shown in FIG. 2, the cap member 20 has hexagonal-shaped apertures 26 spaced along the length of the main web 22. Apertures 26 are about 4¼ inches long by about 1 9/16 inches wide and are typically spaced apart about 6 inches along web 22, although a greater spacing is shown in FIG. 2 for clarity. These apertures 26 allow for the convenient passage of plumbing pipes, electrical conduits, and the like (not shown) through the cap member 20.

Top plates 28 and 29, composed of 2×4 wooden members, are secured to the cap web 22 by nails or the like. Lower top plate 28 typically extends continuously from one end of cap member 20 to the other. Upper top plate 29, when employed, usually terminates short of the ends of the wall section. This allows the wall sections to be secured together easily at the construction site by nailing 2×4 wooden members to the lower top plates 28 between the ends of the upper top plates 29 of two adjacent wall sections.

A pair of shear straps 53 are secured diagonally across one end of wall section 10 in order to provide against the rotation of the studs 40 about their ends in the longitudinal direction of the wall section 10. Straps 53 are typically composed of 16 gauge steel straps, about 2 inches wide, which are secured to the studs 40 by screws 54.

Studs 40 have a row of apertures 49 spaced longitudinally along the length of their main webs 42. These apertures 49 are provided to allow for the convenient passage of electrical conduits (not shown), structural members 55, and the like through the studs 40.

Figure 8:
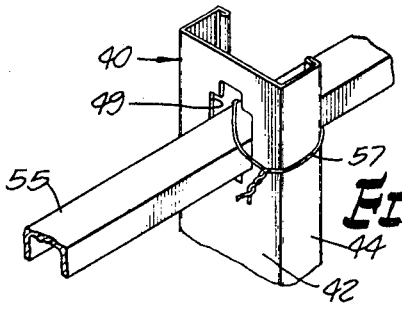
FIG. 8 is a sectional perspective view of an iron bar passing through the studs as is shown in FIG. 2.

As is shown in FIGS. 2 and 8, a structural member, such as steel or black iron bar 55, may be passed through stud apertures 49 in order to provide reinforcing for the wall section 10. Iron bar 55 is a U-shaped channel. Iron bar 55 is secured in stud apertures 49 by a piece of wire 57 or the like passing around the bar 55, through stud aperture 49, and around a stud flange 44. The two ends of the wire 57 are then twisted together.

A grommet or insulating guide 60, shown installed in a stud in FIG. 7, is inserted in various stud apertures 49 to provide both electrical and thermal insulation and to prevent abrasion between the edges of the metal stud aperture 49 and the electrical conduit (not shown) passing through the aperture. The insulating guide 60 is composed of a material which is not easily ignited, or which is not flammable, such as solid plastic, neophrene, or the like. Such an insulating guide is more fully described in patent application Ser. No. 35,648, filed May 8, 1970.

As is shown in FIG. 2, a metal stud 40 is positioned adjacent to the one end of the cap member 20 and floor track member 30 of each wall section 10 to form a closed end for the wall section 10. A wooden or metal end stud 41 is secured adjacent to the other end of wall section 10 in order to provide a closed end for wall section 10 and a corner stud to which another wall section may be secured. In this embodiment of the invention, end stud 41 is in the form of a 4×4 wooden member. If wall section 10 is not to form a corner at one end, two metal studs 40 are used as end studs. These end studs 40 are secured between cap member 20 and the floor track 30 with their flanges facing inwardly towards each other. This orientation of the end studs 40 of the wall section 10 aids in securing various wall sections 10 together.

Wall sections of this invention are secured together by securing the main webs 42 of the end studs 40 together by nails, rivets, screws, or the like. If a corner is to be formed by two wall sections, the web 42 of one metal end stud 40 of one wall section is secured to an end stud 41 of the other wall section by nailing and the like.

In the best embodiment of the invention, the wall sections are secured together by fastening two stud main webs 42 together. All of the wall sections are thus electrically connected together. One or more of the wall sections are connected to ground, thereby electrically grounding all wall sections.

The foregoing description of the invention applies to the best embodiment of all of the wall sections of this invention. However, wall sections 10 and 11 shown in FIG. 1 are adapted for a special function.

Figure 9:
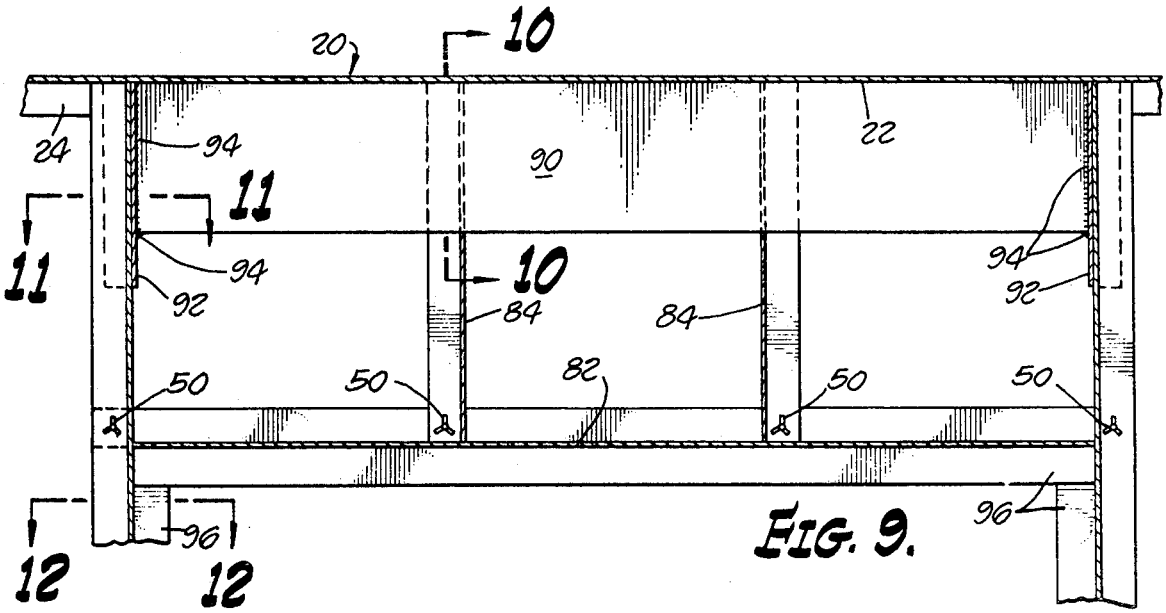
FIG. 9 is a sectional elevation view of a portion of the wall structure along line 9—9 in FIG. 2.
Figure 10:
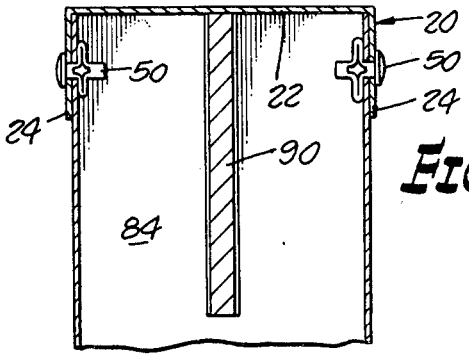
FIG. 10 is a sectional elevation view taken along the line 10—10 of FIG. 9.

FIGS. 2, 9, and 10 show a wall section 10 having an aperture or doorway 80 formed in the wall section. The doorway 80 is defined by an uninterrupted stud 40 on each side of the doorway 80, by the floor track 30, and by a lintel 82 across the top of the doorway 80. Floor track 30 extends across doorway 80 in order to increase the rigidity of the section 10 during shipment. However, track 30 across doorway 80 is cut away thereafter in order to open the aperture 80 at its lower end. An uninterrupted stud 40 is one which extends continuously between the cap member 20 and the track member 30.

The lintel 82 is constructed of a U-shaped channeled member having upwardly facing flanges and is secured to the flanges of the studs 40 on either side of the doorway 80 by rivets 50 or the like.

Cripples 84 are studs 40 which have been cut, fitted, and secured between the cap 20 and the lintel 82. The lower ends of the cripples 84 are secured to the lintel 82 by rivets 50 or the like. Similarly, the upper ends of cripples 84 are secured to cap member 20 by rivets 50.

A header 90 is secured over the doorway 80. The webs 86 (FIG. 10) of the cripples 84 are notched at their upper ends in order to receive the header 90. The header 90 (FIGS. 9 and 11) consists of a plate, such as a ¼ inch thick steel plate, which is secured to a pair of truncated outwardly-facing U-shaped channeled members 92 at each end of the header 90 by welds 94. The header 90 is typically about 8 inches in height and the channels 92 are about 10 inches in length. The top of the header 90 is welded flush with the tops of the channels 92 so that the header will support the web 22 of the cap member 20 when installed. Other types of headers may, of course, be employed.

In order to prevent this portion of wall section 10 from being thicker than the rest of the wall section, channels 92 are constructed with the same width as the rest of the studs 40. In order to fit uninterrupted studs 40 inside of channels 92, the uninterrupted studs 40 on each side of aperture 80 are formed with their webs 42 reduced in width. The studs 40 on each side of the aperture 80 are then fitted inside the respective channels 92. The U-shaped channels 92 are secured to the uninterrupted studs 40 (FIGS. 2 and 11) on each side of the doorway 80 by rivets 50. In this manner, the weight above the doorway 80 is transferred to the uninterrupted studs 40 on each side of the doorway 80 by the header 90.

As is shown in FIGS. 2 and 9, wooden 2×4 surrounds 96 are secured to the inside of the uninterrupted studs 40 on each side of the aperture 80 and to the bottom of the lintel 82. These wooden surrounds 96 are secured to the webs of the metal uninterrupted studs 40 and lintel 82 by nails 98 (see FIG. 12). Surrounds 96 provide for the ready installation of jambs and the like for doorway 80. Surrounds 96 may also be omitted if desired.

Wall section 11 of FIG. 1 has an aperture 102 similar to aperture 80 of wall section 10, except that aperture 102 of section 11 forms a window for the wall section 11. This construction necessitates a sill 104, similar to lintel 82, at the bottom of window aperture 81. Shortened studs 106 are also secured between the floor track 30 and the sill 104. These shortened studs 106 are similar to cripples 84 above aperture 102 and are secured to the sill 104 in a manner similar to the manner in which cripples 84 are secured to lintel 82. Otherwise, the construction of the members surrounding and above window aperture 102 are the same as have been described above.

It will be understood that other apertures, such as other shapes of windows and the like, may be formed in a manner similar to that disclosed above, all within the scope of this invention.

It will be evident that this invention provides a prefabricated lightweight load-bearing wall section suitable for use in the top story of a multiple story building. Also, 26 gauge load-bearing wall sections may be employed in the top story of a multiple story building in combination with load-bearing wall sections in the lower stories having load-bearing studs composed of 20 gauge steel.

Although this invention has been described with reference to a particular embodiment and to particular applications, the principles involved are susceptible to numerous other applications, which will be apparent to those skilled in the art, and the scope of the invention is not to be limited to the preceding embodiments.

The invention claimed is:

1. In a multiple story housing structure having an upper story and a lower story, the combination in which said lower story has a load-bearing wall structure comprising a series of load-bearing studs secured vertically between a cap member and a floor track member, said studs being composed of steel of about 20 gauge thickness; and said top story has a load-bearing top wall structure comprising:

an elongated normally horizontal top cap member adapted to overlie the top of a series of metal studs, said top cap member forming the top of the top wall structure;

an upwardly facing metal top floor track member adapted to receive the lower ends of a series of metal studs, said top floor track member forming the bottom of said top wall structure;

a series of upstanding load-bearing top studs secured vertically between said top cap member and said top floor track member, said top studs being composed of steel of about 26 gauge thickness; and a pair of wooden top plates secured one above the other to the top of said top cap member, the lower top plate being coextensive with the top cap member and the upper top plate being shorter than the top cap member; and a pair of metal straps secured diagonally on opposite sides of the top wall section across a plurality of said top studs; and a stud secured vertically at one end of said top wall section between said top cap member and said top floor track member to provide a corner stud for said top wall section.

2. In a multiple story housing structure having an upper story and a lower story, the combination in which said lower story has a load-bearing wall section comprising a series of non-planar load-bearing studs secured vertically between a cap member and a floor track member, said studs being composed of steel of about 20 gauge thickness; and said upper story has a prefabricated metal load-bearing wall section comprising:

a second downwardly facing elongated normally horizontal channeled cap member, less than approximately 20 feet in length, having a main web and having a flange depending downwardly from each side of said main web, said main web having a plurality of apertures for passing conduits therethrough;

a second upwardly facing elongated normally horizontal channeled floor track member of about the same length as said cap member, said second track member having a main web and having a flange extending upwardly from each side of said main web;

a second series of parallel non-planar metal studs positioned vertically between said second cap member and said second floor track member, said second studs being composed of steel of about 26 gauge thickness, each second stud having at least one aperture in its main web, the upper ends of said second studs bearing against the main web of said second cap member, and the lower ends of said second studs bearing against the main web of said second floor track member, said second studs being positioned at approximately 2 foot intervals along said top wall section, one of said second studs being positioned at each end of said wall section facing towards each other;

said second studs being connected at their upper ends of said second cap member by securing each flange of the cap member to a flange of each stud;

said second studs being connected to said second floor track member at their lower ends by securing each flange of said floor track member to a flange of each stud;

said upper wall section having portions of a plurality of adjacent second studs cut away in order to provide an aperture through said second wall section;

a steel header connected above said second wall section aperture to an uninterrupted second stud on each side of said second wall section aperture; and a pair of wooden top plates secured one above the other to the top of said second cap member, the lower top plate being coextensive with the upper cap member and the upper top plate being shorter than the second cap member;

a pair of metal straps secured diagonally on opposite sides of the second wall section across a plurality of said second studs; and a stud secured vertically at one end of said second wall section between said second cap member and said second floor track member to provide a corner stud for said second wall section.

3. In a multiple story housing structure as defined in claim 2 wherein said upper load-bearing metal wall section further comprises:

a U-shaped metal member secured across the top of said upper wall section aperture to uninterrupted studs on each side of said wall section aperture to form a lintel; and a U-shaped metal member secured across the bottom of said upper wall section aperture to uninterrupted studs on each side of said wall section aperture to form a sill.

4. In a multiple story housing structure as defined in claim 3 wherein:

wooden surround members frame the inside of said upper wall section aperture and are secured to the lintel, to the sill, and to the uninterrupted studs on each side of said wall section aperture.

* * * * *